US006393622B1

(12) United States Patent
Rice

(10) Patent No.: US 6,393,622 B1
(45) Date of Patent: May 28, 2002

(54) FULLY DETACHABLE GARTER SYSTEM

(76) Inventor: Bronwyn C. Rice, 6243 SE. Belmont St., Portland, OR (US) 97215

( * ) Notice: Subject to any disclaimer, the term of this patent is extended or adjusted under 35 U.S.C. 154(b) by 0 days.

(21) Appl. No.: 09/768,978

(22) Filed: Jan. 23, 2001

(51) Int. Cl.[7] ..... A41B 11/00
(52) U.S. Cl. ..... 2/406; 2/409
(58) Field of Search ..... 2/409, 239, 303, 2/302, 304, 306, 307, 313, 314, 315, 322, 335, 69, 400–408

(56) References Cited

U.S. PATENT DOCUMENTS 2,763,008 A * 9/1956 Rosenthal ..... 2/409
3,324,857 A * 6/1967 Froehlich ..... 2/409
3,463,162 A * 8/1969 Heggie ..... 2/409
3,487,473 A * 1/1970 Janhsen ..... 2/409
3,577,993 A * 5/1971 Glucken ..... 2/409
5,027,441 A * 7/1991 Wilson ..... 2/409
5,953,759 A * 9/1999 Bozzini ..... 2/409

* cited by examiner

*Primary Examiner*—Gloria M. Hale
(74) *Attorney, Agent, or Firm*—Ingrid McTaggart

(57) ABSTRACT

A fully detachable garter system comprises an undergarment, downwardly extending straps releasably secured to the undergarment and to a pair of stockings. The upper ends of the straps include fasteners for releasably securing the straps to the undergarment. The lower ends of the straps include fasteners for releasably securing the straps to a pair of stockings. The fasteners on each end of the straps may comprise hook and pile material, snaps, hooks and eyes, button and buttonholes, button hooks, or other such attachment means. The undergarment and the stockings typically include a smooth edge region for fastening of the straps thereto. In other embodiments, the undergarment may include fasteners positioned on an inner surface of the leg openings so that the fasteners are hidden from view. In still another embodiment, the fasteners on the undergarment may be positioned on an outwardly facing surface and disguised by decorative lace or the like.

20 Claims, 5 Drawing Sheets

FULLY DETACHABLE GARTER SYSTEM

TECHNICAL FIELD

The present invention relates to a fully detachable garter system, and more particularly, to a fully detachable garter system which allows the user to attach stockings to an undergarment wherein both the stockings and the attachment straps are detachable from the undergarment so as to provide the undergarment with a standard appearance when the stockings and the straps are removed.

BACKGROUND OF THE INVENTION

Garter belts have been used for many years to secure stockings in an upright position on a wearer's legs. These garter belts typically comprise a belt that is secured about the wearer's waist and includes downwardly extending straps which are sewn to the garter belt and which have releasable fasteners at their lower end for securing the stockings thereto. Garter belts typically are worn on top of and in addition to an undergarment, such as a pair of underpants. This bulky arrangement is not ideally suited for modern, tight-fitting clothes. Moreover, this dual underpants/garter belt arrangement requires the wearer to purchase two separate items, i.e., the underpants and the garter belt.

Accordingly, garter straps have been incorporated into a girdle wherein the girdle has downwardly extending straps sewn to an outside, lower edge of the girdle and wherein the straps each have a releasable fastener at their lower end for securing a pair of stockings thereto. This combined girdle/garter strap arrangement has several disadvantages. The straps are sewn to the girdle so that if the girdle is worn without the stockings attached, the straps will hang loosely and may create an odd appearance under the wearer's outer clothing. Moreover, the loose straps may be visible if the wearer attempts to wear the girdle underneath short outer wear such as short sundresses or shorts. Accordingly, if the wearer desires to wear stockings during the workday and then change into shorts after work, the wearer is required to also change their girdle, which may defeat the purpose of removable stockings.

Additionally, a stocking attachment device has been incorporated into modern underpants wherein the legs of a pair of standard underpants have been substantially lengthened so that the underpants meet with the stockings contiguously around the wearer's thigh region, i.e., without the use of downwardly extending straps. This arrangement securely fastens the stockings to the underpants but does not provide ventilation for the wearer's thigh and crotch region. Such ventilation can be very important in hot and/or humid climates.

Accordingly, there is a need for a fully detachable garter system which allows a wearer to secure stockings to an undergarment, but which allows the undergarment to have a somewhat standard appearance when the stockings are removed. Moreover, there is a need for a detachable garter system which allows stockings to be attached to an undergarment while still providing ventilation to the wearer's thigh and crotch region.

SUMMARY OF THE INVENTION

An object of the present invention is to provide a fully detachable garter system that allows a wearer to secure a pair of stockings to the garter straps of an undergarment wherein the garter straps are fully removable from the undergarment.

Another object of the present invention is to provide a fully detachable garter system which allows a pair of stockings to be attached to an undergarment while still providing ventilation to the wearer's thigh and crotch region.

Still a further object of the present invention is to provide a fully detachable garter system which includes hidden or an absence of fasteners on an undergarment so that the undergarment has a standard appearance when the stockings and the straps are removed.

Accordingly, the device preferably comprises an undergarment, downwardly extending straps releasably secured thereto, and a pair of stockings. The upper ends of the straps include fasteners for releasably securing the straps to the undergarment. The lower ends of the straps include fasteners for releasably securing the straps to a pair of stockings. In another embodiment, the fasteners may be permanently secured to the stockings. The fasteners on each end of the straps, or on just the upper end of the straps, may comprise hook and pile material, snaps, hooks and eyes, buttons and buttonholes, button hooks, or other such attachment means. In one embodiment, the fasteners on the undergarment typically are positioned on an inner side of the leg openings so that the fasteners are hidden from view. In another embodiment, the fasteners on the undergarment may be positioned on an outwardly facing surface and are disguised by decorative lace or the like. In yet another embodiment, the fasteners may be positioned completely on the straps so that the undergarment and the stockings have smooth comfortable surfaces with no fastener permanently mounted thereon. Accordingly, the undergarment of the fully detachable garter system has a standard appearance when the straps and stockings of the present invention are not secured thereto.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DETAILED DESCRIPTION

Figure 1:
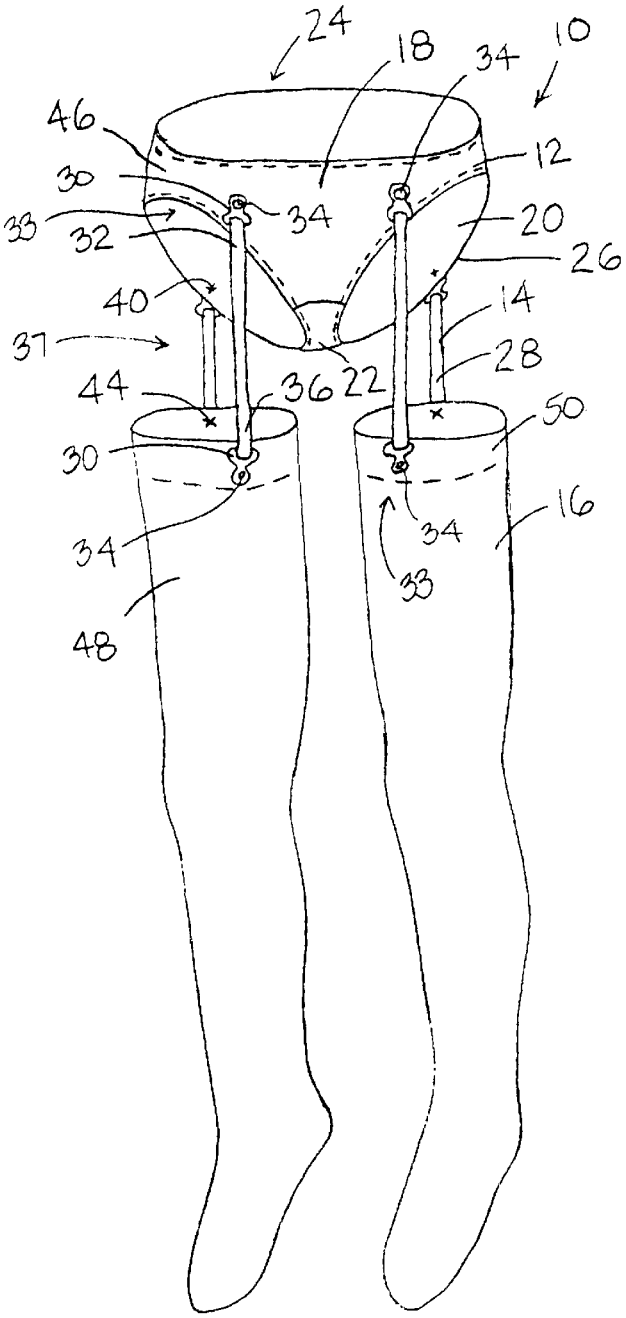
FIG. 1 is a front view of the fully detachable garter system of the present invention including an undergarment, straps, and stockings attached thereto.

Referring now to the figures, FIG. 1 is a front view of the fully detachable garter system of the present invention including an undergarment, straps, and stockings attached thereto. In particular, the fully detachable garter system 10 of the present invention includes an undergarment 12, a set of straps 14 and a pair of stockings 16. Undergarment 12 includes a front panel 18, a rear panel 20, a crotch panel 22 and a waist band region 24. The front, rear and crotch panels define two leg openings 26, as known in the art. The leg openings and the waist region are typically defined by elastic which is sewn into the undergarment with stitching as known in the art. Due to the unique features of the present invention, undergarment 12 may comprise any known size and may have any known shape, such as that of a girdle, a pair of boxers, a brief, a bikini, a slip or any other type or shape of undergarment.

Set of straps 14 typically comprises four straps but any number of straps may be utilized. The straps typically are secured to undergarment 12 adjacent leg openings 26 but any location may be used for releasable securement of the straps thereto. Each of the straps, in the embodiment shown, comprises a length of elastic material 28 which includes a fastener 30 at an upper end 32 that is attached to a fastener 34 secured to the underpants, and another fastener 30 at a lower end 36 secured to a fastener 34 on the stockings. In other embodiments, the straps may comprise a length of non-elastic material and the undergarment may not include a fastener secured thereto, i.e., the fastener is contained completely on the strap. The garter system of the present invention includes a thigh region 37 typically positioned between leg openings 26 and the top edge of leg coverings 16. The straps each have a width less than a width of thigh region 37 so that the straps allow for ventilation in the crotch and thigh region of the garter system. This ventilation may be important when the leg coverings comprise warm materials such as nylon stockings, wool tights, thick cotton tights, silk stockings, and polypropylene coverings. Moreover, this ventilation feature of the present invention may be of particular importance in hot and humid climates, regardless of the thickness of the stockings being worn.

The fasteners may comprise buttons or button holes, button hooks, mating hook and pile material, mating hook and eye pieces, mating snaps pieces, any other such fastening means, and combinations thereof. In other words, fastener sets 33, wherein each set typically includes fasteners 30 and 34, may be different from one another so that different types of fastener sets may be used on a single strap. For example, buttons may be used to attach the straps to the undergarment and hook and pile material may be used to attach the straps to the stockings. Such use of different fastener sets on a single strap provides the straps with pre-defined upper and lower ends so that the fastener may be secured to the undergarment and the stockings in only one orientation. In the embodiment shown, fasteners 30 each comprise button hooks and fasteners 34 each comprise a button sewn, respectively, to the stockings and the leg opening region of the undergarment.

Still referring to FIG. 1, fasteners 34 are secured to the undergarment by stitching 40 (shown on rear panel 20 of the undergarment), and are secured to stockings 16 by stitching 44 (shown on a rear surface of the stockings). In the embodiment shown, fasteners 34 comprise buttons which are received within button hooks 30 of the straps, and which are sewn to an outside surface 46 and 48, respectively, of the undergarment and the stockings. As will be understood by those skilled in the art, outside surface 48 of the stockings typically has a shape which is form fitting to a person's leg. The stockings typically have a thigh end region 50 which is folded over upon itself and secured with stitching or the like. End region 50 may further include elastic to further enhance the ability of the stockings to remain upright when worn in conjunction with the garter straps of the present invention.

Figure 2:
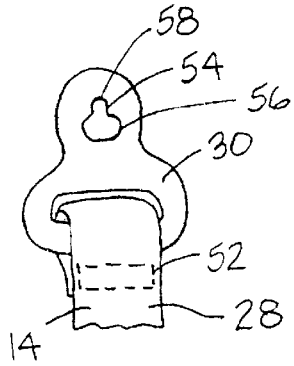
FIG. 2 is a detailed front view of the fastener of the strap of FIG. 1 wherein the fastener comprises a button hole mechanism.

FIG. 2 is a detailed front view of the fastener of the strap of FIG. 1, with the strap removed from the undergarment. Length 28 of elastic material is shown placed through button hook 30 and then secured to itself with stitching 52. In other embodiments, the straps may be manufactured of non-elastic material. The button hook includes an aperture 54 having a lower region 56 sized to allow the placement of a button therethrough and an upper region 58 sized to retain the button within the button hook. The button hook typically is manufactured of flexible plastic, metal having rounded edges, or a similar material or construction so that the hook will not cause injury or pain to the wearer of the undergarment during use.

Figure 3:
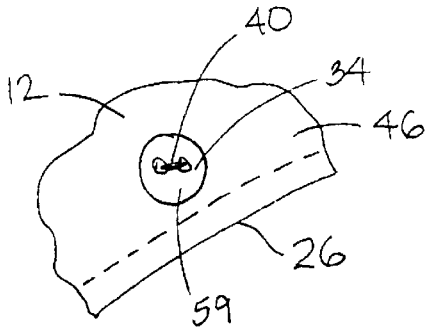
FIG. 3 is a detailed front view of a portion of the undergarment of FIG. 1 wherein the fastener comprises a button.

FIG. 3 is a detailed front view of a portion of the undergarment of FIG. 1 with the strap removed from the undergarment. Button 34 is secured by stitching 40 to undergarment 12 adjacent leg opening 26 on the outside surface 46 of the undergarment. In this embodiment, the button is shown secured inwardly of the edge region of leg opening 26. However, in other embodiments, the button may be sewn directly on the elastic at the edge of leg opening 26 so as to provide added strength to the attachment of button 34 to the undergarment, or the button may be sewn on an inner surface so that the fastener is hidden from view. When button hook 30 is not secured to button 34, the undergarment will have a somewhat standard or normal appearance, with the only noticeable difference being the positioning of button 34 on outer surface 46 of the undergarment. Button 34 has a smooth outer surface 59 so that when the straps are not secured to the undergarment, the button will not give a bulky appearance through the material of an outer garment. In an embodiment where the button is secured to an underside or inner surface of the undergarment, smooth surface 59 of fastener 34 may be referred to as a skin-contacting surface. Accordingly, in such an embodiment the smooth surface provides for comfortable wear of undergarment 12.

Figure 4:
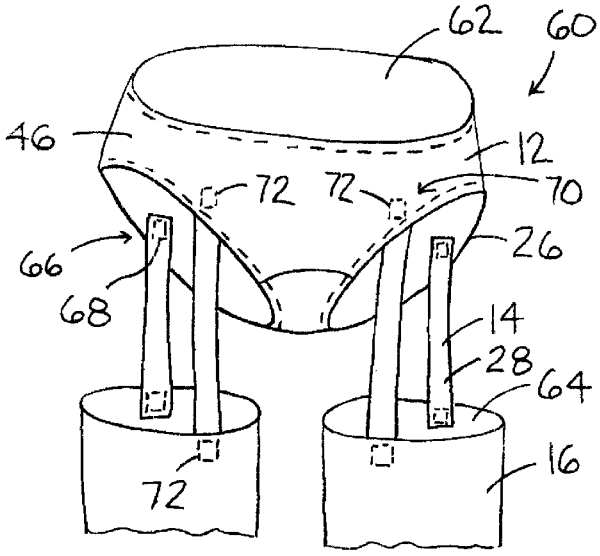
FIG. 4 is a front view of another embodiment of the fully detachable garter system of the present invention.

FIG. 4 is a front view of another embodiment of the fully detachable garter system of the present invention. Garter system 60 comprises an undergarment 12, straps 14, and stockings 16. In this embodiment, straps 14 are releasably secured to an inside surface 62 of the undergarment, and to an inside surface 64 of the stockings. The straps each comprise a length 28 of elastic material including pile material 66 sewn thereto by stitching 68. Undergarment 12 and stockings 16 each include hook material 70 sewn thereto by stitching 72 on inside surfaces 62 and 64, respectively. Of course, the positioning of the hook and pile material on the undergarment and the straps can be reversed. When the straps and the stockings are detached from undergarment 12, the only visible sign on the undergarment of the existence of a garter system is stitching 72. In other words, when the straps are not secured to the undergarment, the undergarment has a normal appearance and does not include any unsightly or bulky straps, hooks or fasteners visible on outside surface 46 of the undergarment. Undergarment 12 can be worn with straps 14 and stockings 16 detached, without the worry of loose or bulky straps or fastening devices becoming visible below the hem line of short sundresses or shorts. Additionally, due to the flat, flexible nature of hook and pile material fasteners, the garter system of the present invention is comfortable to wear, even when the hook or the pile material is on an inner, skin-contacting surface of the undergarment. In other words, the hook material provides a relatively flat outer surface of fastener 34. In another embodiment, a small patch of mating pile material may be used to cover the exposed hook material when no strap is secured thereto. Additionally, due to the provision of detachable straps in the present invention, the detachable garter system provides fully detachable stockings and straps while still allowing ventilation to the wearer's upper thigh and crotch region.

Figure 5:
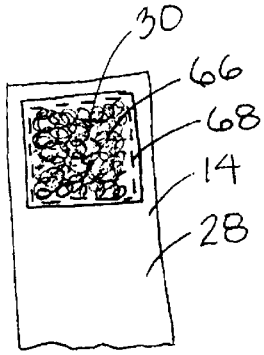
FIG. 5 is a detailed front view of the fastener of the strap of FIG. 4 wherein the fastener comprises pile material.

FIG. 5 is a detailed front view of the fastener of the strap of FIG. 4 wherein the strap has been removed from the undergarment. Strap 28 includes pile material 66 sewn by stitching 68 to the strap. Of course, the hook or the pile material can be sewn to either the strap or to the undergarment or the stockings, as is desired. In the preferred embodiment, the pile material will be sewn to the inside surface of the undergarment, due to the softness of the pile material when compared to the softness of the hook material.

Figure 6:
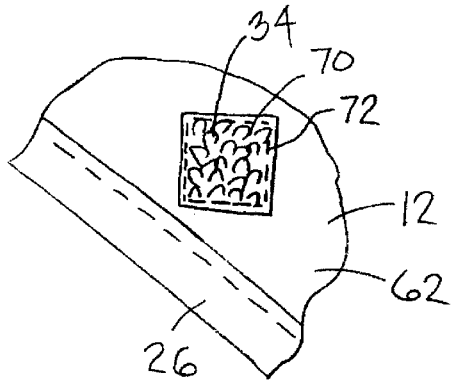
FIG. 6 is a detailed rear view of a portion of the undergarment of FIG. 4 wherein the fastener comprises hook material.

FIG. 6 is a detailed rear view of a portion of the undergarment of FIG. 4 wherein the strap has been removed from the undergarment. Hook material 70, or the pile material, is secured by stitching 72 to undergarment 12 adjacent leg opening 26 on the inside surface 62 of the undergarment. In this embodiment, the hook material is shown secured inwardly of the edge region of leg opening 26. However, in other embodiments, the hook material may be sewn directly on the elastic at the edge of leg opening 26 so as to provide added strength to the attachment of hook material 70 to the undergarment. When pile material 66 of the strap is not secured to mating hook material 70, the undergarment will have a somewhat standard or normal appearance, with the only noticeable difference being stitching 72 on outer surface 46 of the undergarment.

Figure 7:
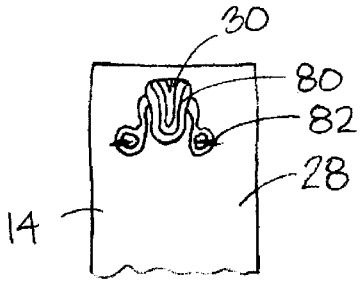
FIG. 7 is a detailed front view of the fastener of a strap of the present invention wherein the fastener comprises a hook mechanism.

FIG. 7 is a detailed front view of the fastener of a strap of the present invention wherein the fastener comprises a hook mechanism. In particular, fastener 30 on strap 28 comprises a metal hook 80 sewn to the strap by stitching 82. When the strap is connected to an inner surface of the undergarment, the material of strap 28 will be positioned between hook 80 and the wearer's skin so that the garter system of the present invention is comfortable to the user of the system.

Figure 8:
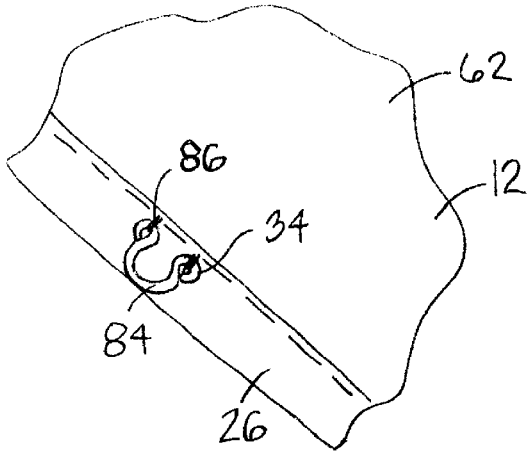
FIG. 8 is a detailed rear view of a portion of the undergarment of the present invention wherein the fastener comprises an eye mechanism.

FIG. 8 is a detailed rear view of a portion of the undergarment of the present invention wherein the fastener comprises an eye mechanism. In particular, fastener 34 on undergarment 12 comprises a metal eye 84 sewn to the undergarment by stitching 86 in the elastic edge region of leg opening 26. Metal eye 84 is sized to receive hook 80 of FIG. 7 so as to secure the strap to the undergarment. The flat shape of eye 84 will allow it to lie against the wearer's leg when the strap is not connected to the undergarment, so that the eye will not be visible and will not provide any discomfort to the wearer. Metal eye 84 is sewn in the elastic region of leg opening 26 so as to provide a stable support base for stitching 86 to secure the metal eye in place. The hook and eye of FIGS. 7 and 8 may also be provided in plastic or other such suitable materials.

The type of fastener secured to the undergarment typically will be the same type of fastener that is secured to the pair of stockings so that the straps can be used in any orientation to secure the stockings to the undergarment. In other words, when pile material is sewn to the undergarment, pile material will typically also be sewn to the stockings as a fastener material. Likewise, when a metal hook is sewn to the strap, metal eyes will be sewn to both the undergarment and the stockings. Moreover, in a preferred embodiment, which will be discussed in more detail below, the stockings and the undergarment include no fastening means wherein the garter strap includes both fasteners 30 and 34 secured to each end of the strap.

Figure 9:
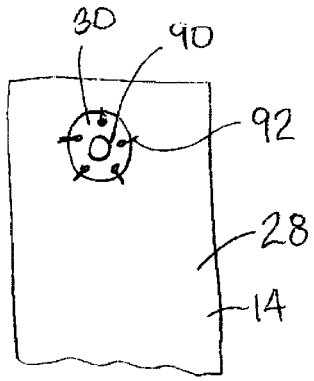
FIG. 9 is a detailed front view of the fastener of a strap of the present invention wherein the fastener comprises a snap protrusion.

FIG. 9 is a detailed front view of fastener 30 of strap 28 of the present invention wherein the fastener comprises a snap protrusion 90 secured to the strap by stitching 92.

Figure 10:
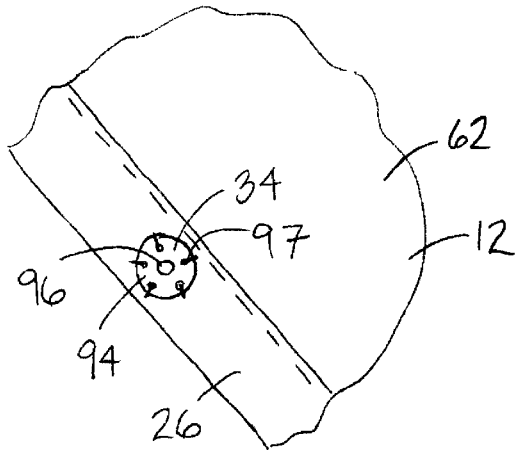
FIG. 10 is a detailed rear view of a portion of the undergarment of the present invention wherein the fastener comprises a snap receiving aperture.

FIG. 10 is a detailed rear view of a portion of the undergarment of the present invention wherein fastener 34 comprises a snap piece 94 including a snap receiving aperture 96. The snap piece is secured to inside surface 62 of undergarment 12 by stitching 97. The flat shape of snap 94 will allow it to lie against the wearer's leg when the strap is not connected to the undergarment, so that the snap piece will not be visible and will not provide any discomfort to the wearer.

Figure 11:
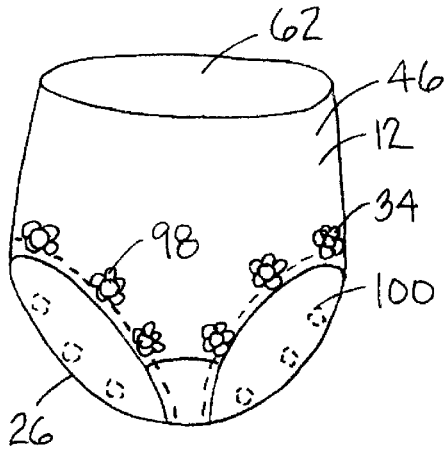
FIG. 11 is a front view of an undergarment of the present invention wherein the undergarment fasteners for securing a strap thereto are disguised as flower shaped patches.

FIG. 11 is a front view of undergarment 12 of the present invention wherein undergarment fasteners 34 for securing a strap thereto are disguised as flower shaped patches 98. Patches 98 are sewn to outside surface 46 of the undergarment by stitching 100, which can be seen on inside surface 62 of rear panel 20 of the undergarment. In another embodiment, the patches may be secured by adhesive or the like. Multiple patches 98 are shown positioned around leg openings 26 so that many straps can be used to secure each leg of the pair of stockings to the undergarment, or just one or two straps per stocking can be placed in a variety of arrangements around the leg openings.

Those skilled in the art will understand that other shapes and sizes of patches may be used to disguise fasteners 34. In particular, the patches may be in the shape of bumble bees or lady bugs, or a continuous piece of lace may be positioned around the leg opening or at other locations on the undergarment wherein the lace may include sections to which the straps may be secured. The patches may also comprise no designer shape but simply a square or a round shape. In another embodiment the patches, when not in use, may be hidden between two folds of material.

Figure 12:
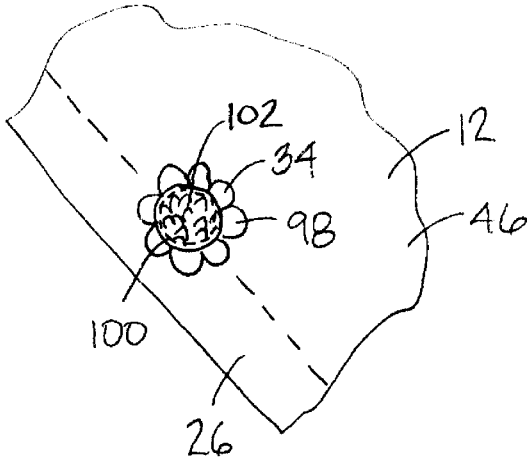
FIG. 12 is a front view of a portion of the undergarment of FIG. 11 wherein the fastener comprises a section of hook material positioned in the central region of a flower shaped patch.

FIG. 12 is a front view of a portion of the undergarment of FIG. 11 wherein patch 98 includes a central section 102 comprising hook material for attachment of a strap thereto. In other embodiments, central section 102 may include pile material, a snap receiving aperture, a metal eye, a metal hook, a button, a button hole, a button hook, or other such fastening device disguised within the outer shape of patch 98. In this embodiment, a strap having pile material fastened thereto will mate with the hook material of patch 98 so as to secure the strap, and therefore the stockings, in place to the undergarment. When the straps and the stockings are not secured to the undergarment, the flower shape of the patch will disguise the intended purpose of the patches.

Accordingly, the present invention provides a garter system wherein stockings may be secured to an undergarment and wherein the system allows ventilation to the crotch and upper thigh area of the wearer, while allowing the undergarment to maintain a normal appearance when the straps and the stockings are removed. A wearer, therefore, is able to wear stockings during a portion of the day and then remove the stockings without being required to change their undergarment. Due to the detachable nature of the straps of the present invention, the undergarment, when worn without the straps, is comfortable and does not include unsightly and/or bulky attachments. Moreover, due to the fully removable nature of the straps, straps of differing styles and colors can be coordinated with different undergarments to provide unique styling options to the wearer.

Figure 13:
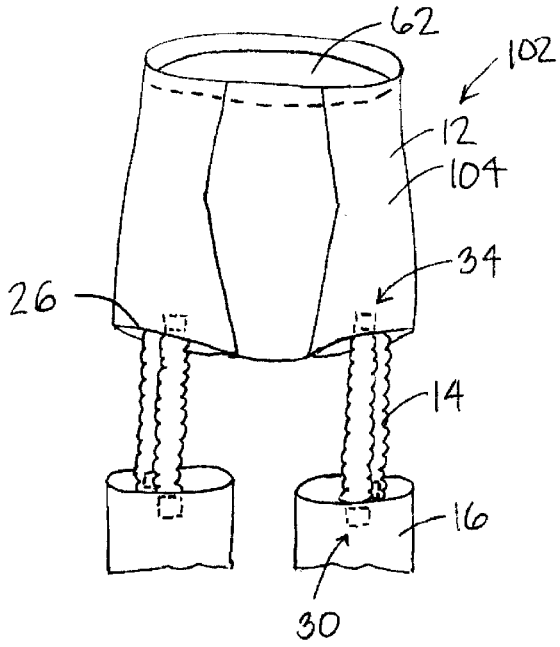
FIG. 13 is a front view of another embodiment of the undergarment and straps of the present invention wherein the undergarment comprises a girdle.

FIG. 13 is a front view of another embodiment of the undergarment of the present invention. Garter system 102 includes a girdle 104 including fasteners 34 secured to inner surface 62 of the girdle. Straps 14, with stockings 16 attached thereto, are secured to the girdle by fasteners 34. In this embodiment, fasteners 34 comprise pile material while the straps include mating hook material 30 secured thereto. In this embodiment, straps 14 are shown manufactured of a fancy lace-edged material. The lace straps are slightly shorter than those shown in FIG. 1 due to the lower positioning of leg openings 26 of the girdle with respect to those of the underpants of FIG. 1. The length of the straps can also be varied so as to accommodate stockings in a variety of lengths. The straps will preferably be of a length, however, so as to allow ventilation of the crotch and upper thigh area of the wearer.

Figure 14:
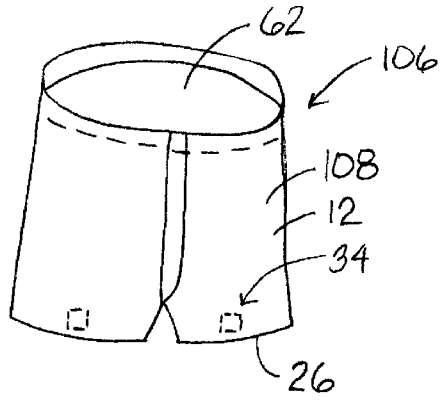
FIG. 14 is a front view of another embodiment of the undergarment of the present invention wherein the undergarment comprises a pair of boxer shorts.

FIG. 14 is a front view of another embodiment of the undergarmnent of the present invention. In this embodiment, garter system 106 comprises a pair of boxer shorts 108 including fasteners 34 (indicated by dash lines) secured to inside surface 62. The fasteners are secured to inside surface by adhesive so that the outward appearance of the boxer shorts gives no indication that garter straps may be secured thereto. In another embodiment, the fasteners may be secured by stitching or the like.

Figure 15:
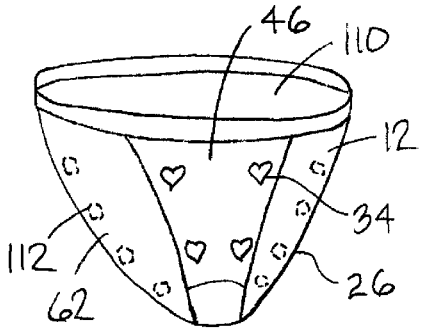
FIG. 15 is a front view of another embodiment of the undergarment of the present invention wherein the undergarment comprises a pair of bikini briefs.

FIG. 15 is a front view of another embodiment of the undergarment of the present invention wherein undergarment 12 comprises a pair of bikini pants 110. Fasteners 34 comprise heart-shaped patches secured to outside surface 46 of the bikini pants. The heart-shaped patches include a central region of pile material that will mate with corresponding hook material on straps 14. The heart-shaped patches are secured to the undergarment by stitching 112 which can be seen on inside surface 62 of the undergarment. In other embodiments, the patches may have a different outer shape, may include different fastening means therein or may be positioned on the waistband for added durability of design.

Figure 16:
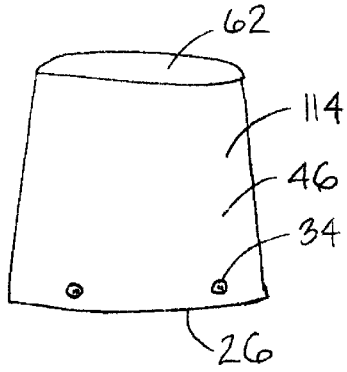
FIG. 16 is a front view of another embodiment of the undergarment of the present invention wherein the undergarment comprises a slip.

FIG. 16 is a front view of another embodiment of the undergarment of the present invention wherein undergarment 12 comprises a slip 114 including a single leg opening 26. Fasteners 34 comprise buttons sewn to outside surface 46 of the slip. Those skilled in the art will understand that the slip, and the other undergarments used in conjunction with the present invention, will have a waistband or other means to retain the undergarment in position on the wearer so that the undergarment will not be pulled downwardly by the force of the stockings and the straps of the garter system.

Figure 17:
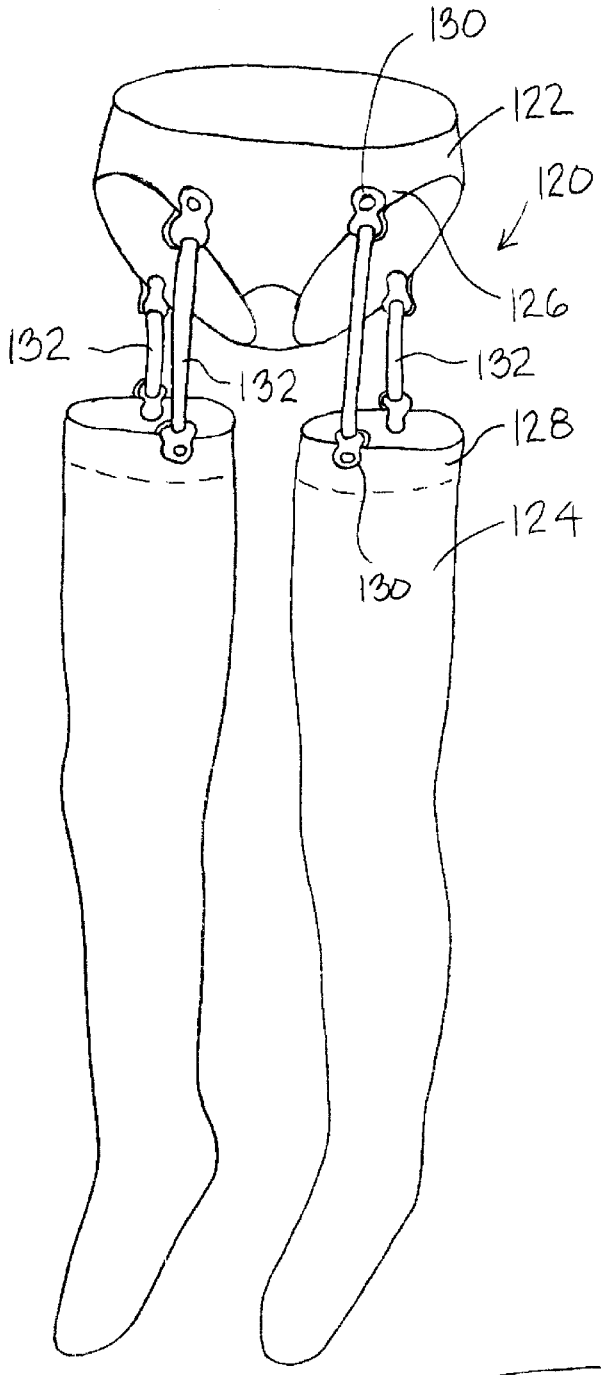
FIG. 17 is a perspective view of the preferred embodiment of the undergarment invention wherein the fastening means are contained completely on the garter straps.

FIG. 17 shows a preferred embodiment of the garter invention 120 wherein undergarment 122 and stockings 124 include smooth attachment surfaces 126 and 128, respectively, with no fasteners positioned thereon. In other words, fastening devices 130 for securing straps 132 to the stockings and the undergarment are contained on garter straps 132 exclusively. Accordingly, when straps 132 are removed from attachment to undergarment 122, the undergarment will have a normal appearance with no fasteners positioned thereon. Similarly, when straps 132 are removed from attachment to stockings 124, the stocking will have a smooth appearance with no fasteners positioned thereon.

Figure 18:
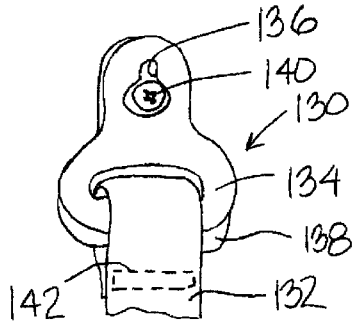
FIG. 18 is a front view of the fastening means on the garter strap of FIG. 17.

FIG. 18 shows a front view of the preferred fastening device 130 secured to strap 132. Fastener 130 includes a first tab portion 134 including a button hole 136 extending therethrough, and a second tab portion 138 having a button 140 secured thereto. In this figure, tab portion 138 is seen behind first tab portion 134 and button 140 is viewed through button hole 136. Both tab portions 134 and 138 are secured to strap 132 by stitching 142 or the like.

Figure 19:
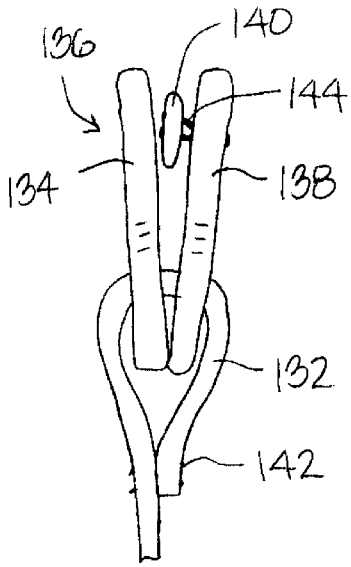
FIG. 19 is a side view of the fastening means of FIG. 18.

FIG. 19 shows a side view of the preferred fastening device wherein first and second tab portions 134 and 138 are shown connected to strap 132. In use, first tab portion 134 typically is positioned on an outside surface of the underpants, and second tab portion 138 is positioned on an inside surface of the underpants. The tabs preferably are positioned adjacent a leg opening of the underpants in a position to hang downwardly therefrom. Button 140 is placed through the larger, lower portion of button hole 136 with the material of the underpants covering the button. First tab portion 134 is then pulled downwardly, i.e., away from the underpants, so that stitching 144, which secures button 140 to second tab 138, is positioned within the smaller, upper portion of button hole 136 with the material of the underpants still covering the button. In this manner fastener 130, and thereby strap 132, is secured to the underpants without requiring a fastening device on the underpants. In a similar manner, a fastener at the opposite end of strap 132 is secured to a stocking so as to secure the stocking to the underpants. Accordingly, a fully detachable leg covering is disclosed wherein the removable straps can be secured to a pair of underpants without requiring a fastener to be permanently mounted on either the underpants or the pair of stockings.

Figure 20:
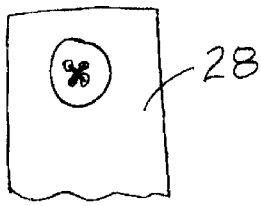
FIG. 20 is a front view of a fastener wherein the fastener comprises a button.

FIG. 20 shows strap 28 including a fastener that comprises a button.

While preferred embodiments of the present invention have been shown and described, it will be apparent to those skilled in the art that many changes and modifications may be made without departing from the invention in its broader aspects. The appended claims are intended to cover, therefore, all such changes and modifications as fall within the true spirit and scope of the invention.

I claim:

1. A fully detachable garter system comprising:

an undergarment including at least two fastening means each adapted for releasably securing a strap thereto;

a first strap adapted for releasable securement to one of said fastening means of said undergarment; and a second strap adapted for releasable securement to another one of said fastening means of said undergarment, wherein said first and second straps are each adapted for securement to a leg covering.

2. The system of claim 1 further comprising a first leg covering secured to said first strap, and a second leg covering secured to said second strap.

3. The system of claim 2 wherein said first leg covering is releasably secured to said first strap, and wherein said second leg covering is releasably secured to said second strap.

4. The system of claim 1 wherein said at least two fastening means of said undergarment each comprise a device chosen from the group consisting of hook material, pile material, a button, a button hole, a button hook, an eye, an eye hook, a snap protrusion, and a snap protrusion receiving piece.

5. The system of claim 1 wherein said at least two fastening means of said undergarment are positioned on an inner surface of said undergarment.

6. The system of claim 1 wherein said at least two fastening means of said undergarment are positioned on an outer surface of said undergarment and are disguised within a decorative ornamentation.

7. The system of claim 1 wherein said straps provide ventilation to a crotch region and a thigh region of said system.

8. The system of claim 1 wherein said undergarment includes a waistband and wherein at least one of said fastening means is positioned on said waistband.

9. A garter system comprising:

a pair of underpants comprising at least one leg opening, and a securement strap including a fastener adapted for releasable securement to said pair of underpants adjacent said at least one leg opening, and said securement strap being further adapted for securing a stocking to said securement strap.

10. The garter system of claim 9 wherein said securement strap further comprises a second fastener adapted for releasable securement to a stocking.

11. The garter system of claim 10 further comprising a stocking adapted for being fastened to said securement strap, wherein said strap allows ventilation to an upper thigh region of said garter system positioned between said leg opening of said underpants and said stocking.

12. The garter system of claim 9 wherein said fastener includes a first tab portion and a second tab portion adapted for capturing said underpants therebetween.

13. The garter system of claim 12 wherein said first tab portion includes a button hole and said second tab portion includes a button.

14. The garter system of claim 9 wherein said pair of underpants is chosen from the group consisting of a pair of briefs, a pair of bikini pants, a slip, a pair of boxer shorts, and a girdle.

15. A fully detachable garter system comprising:

underpants including at least one leg opening;

a strap including a fastening device adapted for removable securement to said underpants; and a leg covering adapted for securement to said strap.

16. The system of claim 15 wherein said strap has a width less than a width of a thigh region of said system such that said strap allows for ventilation of said thigh region.

17. The system of claim 15 wherein said fastening device of said strap comprises a fastener chosen from the group consisting of: a button, a button hook, hook material, pile material, an eye, an eye hook, a snap protrusion, and a snap protrusion receiving base.

18. The system of claim 15 wherein said leg covering is chosen from the group consisting of nylon stockings, wool tights, cotton tights, silk stockings, and polypropylene coverings.

19. The system of claim 15 wherein said underpants include two leg openings and at least two fastening devices positioned adjacent each of said leg openings.

20. The system of claim 19 wherein said system includes a strap removably secured to each fastening device of said underpants, wherein said system includes two leg coverings, and wherein each of said leg coverings is secured adjacent a corresponding one of said leg openings.

* * * * *